United States Patent [19]

Creed

[11] Patent Number: 4,515,099

[45] Date of Patent: May 7, 1985

[54] THREAD SEVERING ARRANGEMENT FOR THREAD WINDING BOBBIN

[75] Inventor: Gerald J. Creed, Rahway, N.J.

[73] Assignee: The Singer Company, Stamford, Conn.

[21] Appl. No.: 573,733

[22] Filed: Jan. 25, 1984

[51] Int. Cl.[3] ..... D05B 59/00; D05B 57/08

[52] U.S. Cl. ..... 112/279; 112/289; 112/297

[58] Field of Search ..... 112/184, 186, 279, 289, 112/297

[56] References Cited

U.S. PATENT DOCUMENTS

| | | | |
|---|---|---|---|
| 603,688 | 5/1898 | Hawes | 112/289 |
| 3,115,855 | 12/1963 | Ketterer | 112/184 |
| 3,693,565 | 9/1972 | Ketterer | 112/184 |
| 3,783,813 | 1/1974 | Kroll | 112/289 |
| 4,108,097 | 8/1978 | Gross et al. | 112/289 X |
| 4,259,914 | 4/1981 | Johnson | 112/184 |
| 4,326,474 | 4/1982 | Zylbert | 112/184 |
| 4,462,324 | 7/1984 | Larsen | 112/279 |

*Primary Examiner*—Wm. Carter Reynolds

*Attorney, Agent, or Firm*—William V. Ebs; Robert E. Smith; Edward L. Bell

[57] ABSTRACT

An axially movable plunger in a bobbin, and a cam for disposing the plunger in a position resulting in rotation of the bobbin for bobbin winding are formed with engageable planar surfaces, one of which includes a sharp edge hole, and the other of which includes an elongate slot to provide for the cutting of thread between the edges of the hole and slot at the outset of a bobbin winding operation.

6 Claims, 11 Drawing Figures

Fig. 3
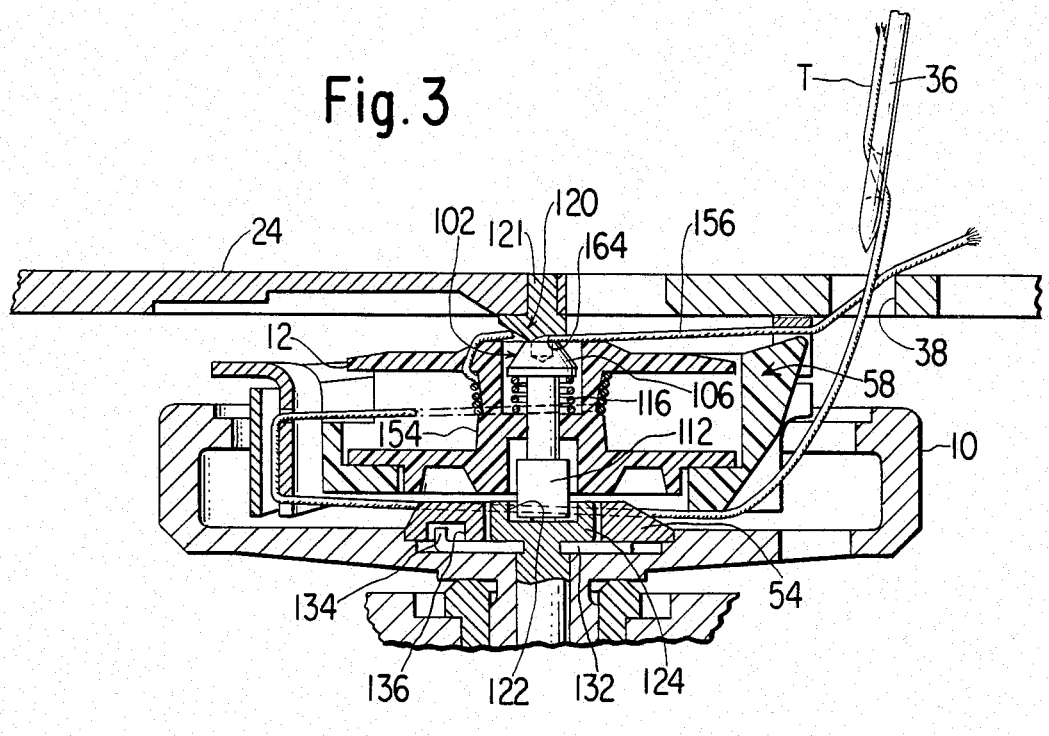
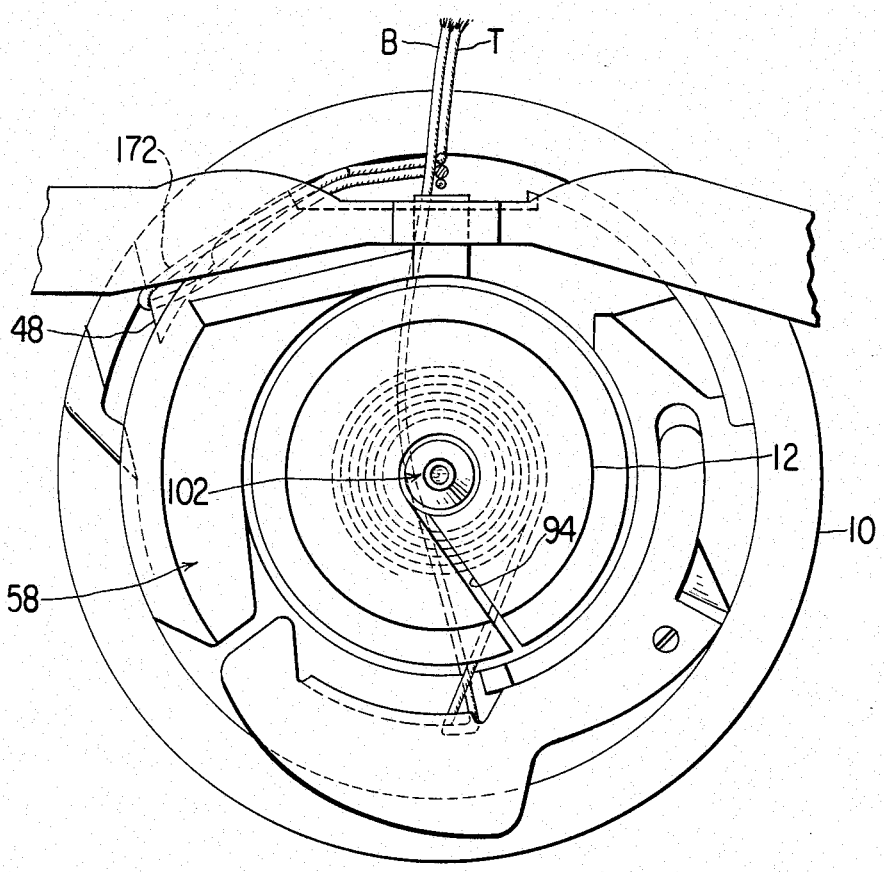
Fig. 4

THREAD SEVERING ARRANGEMENT FOR THREAD WINDING BOBBIN

BACKGROUND OF THE INVENTION

1. Field of the Invention

The invention relates to thread winding sewing machine bobbins.

2. Description of the Prior Art

Mechanisms for replenishing thread on a sewing machine bobbin while in place within the looptaker and bobbin of the machine, as shown for example in U.S. Pat. No. 4,259,914 of R. E. Johnson for "Bobbin Winding Mechanism for a Sewing Machine", issued April 7, 1981, and in U.S. Pat. No. 4,326,474 of T. J. Zylbert for "In-Place Bobbin Winding Mechanism for a Sewing Machine" issued April 27, 1982 include devices for severing a tag end portion of sewing thread at the bobbin. However, such devices have not always functioned as intended, and as a consequence a wound bobbin has at times been left with a tag end portion of thread which interfered with the formation of stitches when a sewing operation was initiated. Furthermore, such thread severing devices have tended to catch thread being moved about the bobbin case by the looptaker during a sewing operation and have so interfered with stitch formation.

It is a prime object of the invention to improve the effectiveness of thread severing devices in bobbin winding mechanism.

It is another object of the invention to eliminate interference of such devices with sewing thread during stitch formation.

Other objects and advantages of the invention will become apparent during a reading of the specification taken in connection with the accompanying drawings.

SUMMARY OF THE INVENTION

An axially movable but rotationally confined plunger in the thread winding bobbin of a sewing machine is provided with a top planar surface on a control button which normally projects above the bobbin, but is depressible by a slide plate cam of a sewing machine into a position for connecting the plunger and thereby the bobbin to a rotating driver. The slide plate cam is provided with a bottom planar surface which engages the top surface of the control button to depress the plunger. One of the said planar surfaces has a sharp edged hole therein and the other planar surface includes a sharp edged elongate slot which is disposed to extend across the edge of said hole and across the edge of said one planar surface in a predetermined position of the slide plate with respect to the bobbin wherein the plunger is depressed by the cam. Sewing thread is cut by the sharp edges of said slot and hole as the plunger and bobbin are rotated relative to the cam.

In the preferred form of the invention, the sharp edged hole is formed in the control button, the elongated slot is formed in the slide plate cam, and said elongate slot extends in the direction of the sewing needle from a location inwardly from the edge of the bottom planar surface of the slide plate cam.

DESCRIPTION OF THE DRAWINGS

FIG. 3 is a sectional view similar to FIG. 2 but showing the slide plate in a partially open position for bobbin winding;

FIG. 4 is a plan view showing the looptaker and bobbin of the machine during a sewing operation;

DESCRIPTION OF THE PREFERRED EMBODIMENT

Figure 1:
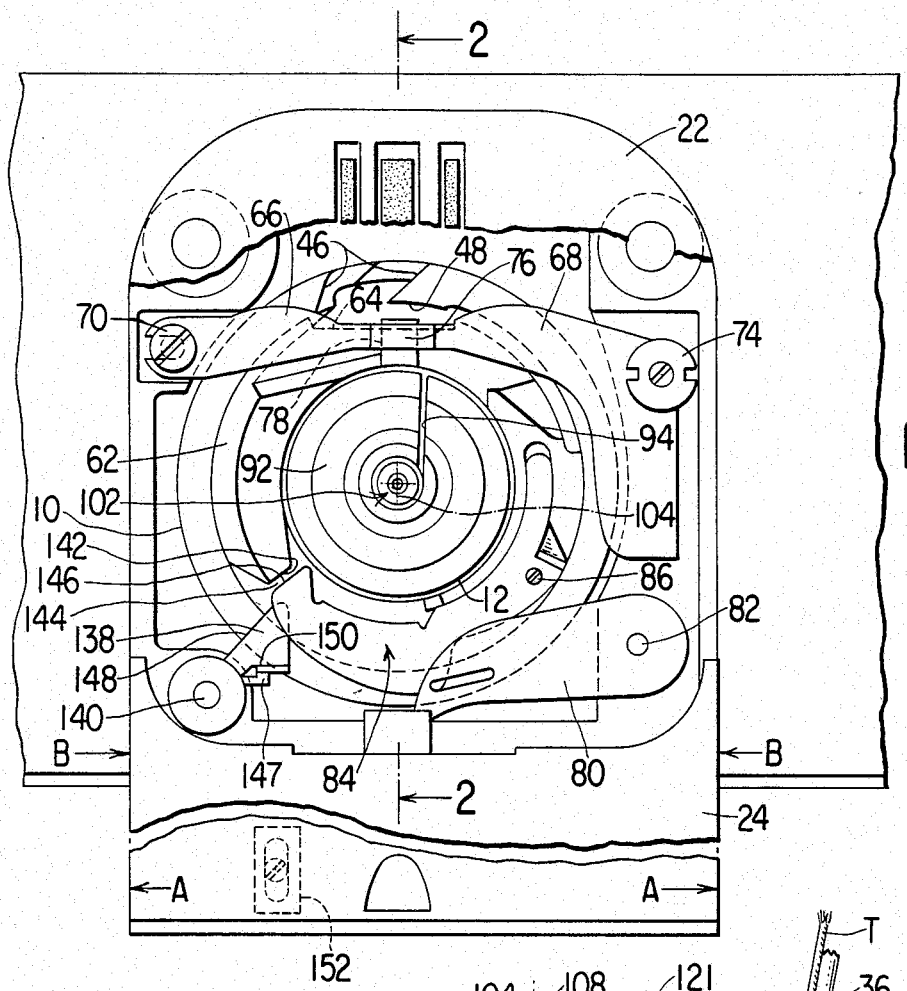
FIG. 1 is a top plan view of a portion of the bed of a sewing machine according to the invention with a slide plate for use over the looptaker of the machine in a full open position.

Referring to the drawings, reference character 10 designates the looptaker of a sewing machine which is provided with mechanism of the kind shown and described in U.S. Pat. No. 4,326,474 mentioned hereinbefore for winding a bobbin 12. As shown, looptaker 10 includes as an integral part thereof, a hollow shaft 14 which is journalled in a bushing 16. The bushing is carried in sewing machine bed 18 which is formed with an upwardly open looptaker accommodating cavity 20. A throat plate 22 partially covers the cavity, and a slide plate 24 is movable over the remaining portion of the opening.

Turning movement is imparted in one direction during operation of the sewing machine to the looptaker 10 by a bevel gear 26 made fast on the looptaker shaft by a set screw 28, and in mesh with a bevel gear 30 on a driving bed shaft (not shown). Preferably, the looptaker makes two revolutions during each cycle of endwise reciprocation of a needle 36 which cooperates therewith in the formation of stitches passing through a needle hole 38 in the throat plate 22.

The looptaker 10 has an upwardly open cupshaped form including a rim 40 having an upwardly extending bearing shoulder 42. The rim is also formed with an annular inwardly extending bearing rib 44 having a lateral opening 46 formed at one side with a thread loop seizing beak 48. Needle 36 reciprocates in a path which traverses the plane containing the path of circular movement of the loop seizing beak 48. The looptaker includes a base 50 with an arcuate opening 52 to provide clearance for the tip of the needle. A thread pull-off member 54 supported on a step 55 is secured to the base 50 with a screw (not shown).

Constrained within the cupshaped looptaker is a bobbin case indicated generally at 58. The bobbin case is formed with an upwardly open bobbin accommodating cavity 59, and with an annular base 60 through which there extends a large central control aperture 61. Externally the bobbin case is formed with a bearing flange 62 which rests upon the bearing rib 44 of the looptaker and is constrained radially against the bearing shoulder 42. The bobbin case flange is slabbed at one side as at 64, substantially along a chord to provide clearance for the path of needle reciprocation between the bobbin case and looptaker. Arms 66 and 68 of a bobbin case restraining member which is secured to the sewing machine bed 18 by a screw 70 and nut 74 restrain upward movement of the bobbin case, and a connecting bridge 76 brackets a bobbin case abutment 78 to restrain rotation of the bobbin case. An arm 80 pivoted at 82 in the bed may be positioned as shown in FIG. 1 to assist in holding down the bobbin case, and may be moved off the bobbin case to permit its removal from the looptaker.

Bearing flange 62 of the bobbin case is formed to accommodate a thread tensioning spring bracket 84 attached to the bobbin case by a screw 86. A turned down arm 88 of the thread tensioning spring bracket 84 extends adjacent the outside of the bobbin case 18, and supports a bobbin thread tensioning spring 90 thereon.

Figure 2:
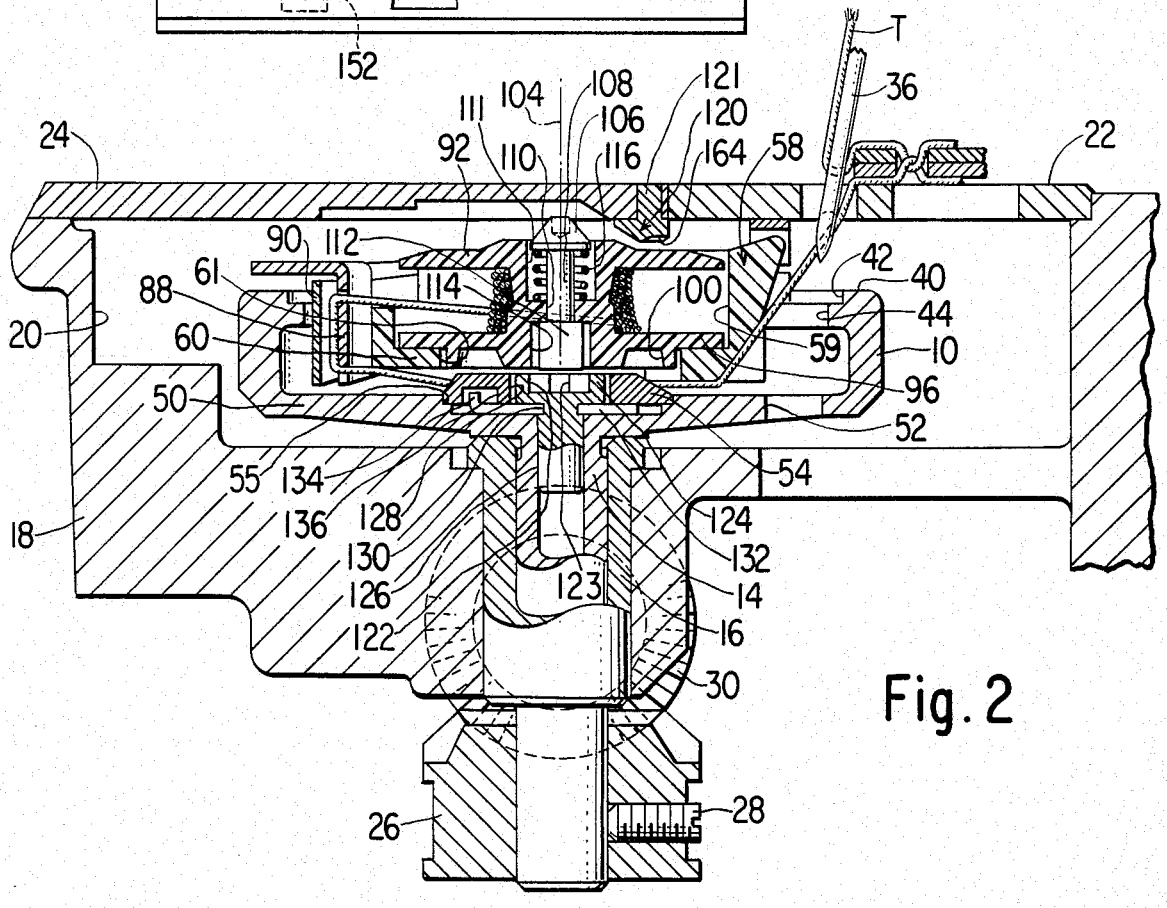
FIG. 2 is a sectional view on the plane of the line 2—2 of FIG. 1 showing the slide plate in a closed position.

Bobbin 12 is rotatable within cavity 59 of the bobbin case 58. The bobbin includes a top flange 92 formed with an outwardly extending slot 94 skewed slightly from a true radial position on the flange. The bobbin further includes a bottom flange 96 which rests on annular base 60 of the bobbin case, and a depending boss 100 which extends into the bobbin case aperture 61. A plunger 102 is mounted in the bobbin for slidable movement along the bobbin's axis of rotation 104. The plunger includes a top button 106, a cylindrical portion 108 slidable in a central bobbin aperture 110, and a key portion 112 slidable in a key accommodating slot 114 in the bobbin. A biasing spring 116 surrounding cylindrical portion 108 of the plunger under button 106 and located in a deep recess 111 in the bobbin, urges the plunger upwardly to a raised position defined by engagement of the upper ends of key 112 with the upper end of the bobbin slot 114. The plunger is so positioned for the performance of sewing operations while slide plate 24 is in the closed position of FIG. 2.

A cam 120 is provided on the slide plate 24 to engage button 106 and urge the plunger 102 downwardly in the bobbin 12 against the biasing spring 116 when the slide plate is in a partially open position as defined, for example, by an alignment of arrows A on the slide plate with arrows B on the machine bed 18. The cam 120 is attached to the underside of the plate by way of a stub shaft 121 which extends from the cam and is force fitted into the plate. The downward urging of plunger 102 by cam 120 in the partially open position of plate 24 causes a bottom end portion of the key 112 on the plunger, during operation of the machine, to enter a key accommodating slot 122 or 123 in the upper end of a chuck 124 when the slot is rotationally aligned to receive the key (see FIG. 3). The plunger is thereby coupled to the chuck to provide for rotation of the bobbin 12 with the looptaker 10, and the winding of thread on the bobbin.

Chuck 124 includes a stub shaft 126 which is mounted for rotation in hollow looptaker shaft 14 about an axis common to both the plunger 112 and shaft 14. The upper end of chuck 124 including key accommodating slots 122 and 123 is located in an opening 128 in bobbin thread pull-off member 54 which as already noted, is secured to looptaker 10. Such pull-off member serves a well understood function in pulling off and positioning bobbin thread during a sewing cycle as described for example for bobbin thread pull-off structure in U.S. Pat. No. 3,693,565, of Sept. 26, 1972. The chuck 124 is frictionally engaged as described in the said U.S. Pat. No. 3,693,565, in an annulus 130 by the end portions of a spring clutch 132 having a tang 134 thereon which extends into a slot 136 in the pull-off member to establish a driving connection between the pull-off member and chuck through the clutch.

A thread guiding finger 138 is pivotally mounted in bed 18 on a pin 140 located approximately opposite a thread accommodating passageway between one edge 142 of a bobbin case opening 144 and one extremity 146 of the bracket 84 which supports the bobbin thread tensioning spring 90. The thread guiding finger 138 is biased by a torsion spring (not shown) toward a position of engagement with a stop 147 and is caused to assume such position whenever the slide plate 24 is in any position except a fully closed position. In the stop engaged position of finger 138, one edge 148 thereof is disposed to engage and guide needle thread T into the thread accommodating passageway in the bobbin between edge 142 and extremity 146 of the opening 144 and bracket 84 respectively as the thread is moved around bobbin case 58 by looptaker 10. Finger 138 includes an upstanding tang 150. The tang 150 is engaged by a slidably adjustable cam 152 on the underside of slide plate 24 when the slide plate is moved to its closed position for sewing, and the finger 138 is then moved to and held by the cam 152 in a position wherein edge 148 no longer directs thread to the thread accommodating passageway in the bobbin.

When it is desired to replenish thread on the bobbin 12, an operator detains the free end of thread extending from the eye of needle 36 above the throat plate 22, and moves slide plate 24 into its partially closed position wherein cam 120 is caused to engage button 106 of plunger 102. The operator then initiates operation of the machine to cause reciprocation of the needle 36 and rotation of the looptaker 10. The plunger 102 which is coupled to chuck 124 by the downward urging of cam 120, as described hereinbefore, is rotated by the looptaker attached pull-off member 54 acting through spring clutch 132 and the chuck 124. Bobbin 12 is rotated by the plunger acting through key 112, and the thread winding operation takes place as described in U.S. Pat. No. 4,326,474.

On the first dip of the needle, the looptaker beak 48 seizes a loop of thread presented by the needle, and as rotation of the looptaker continues, the seized needle thread loop separates into an upper loop extending over the bobbin case and a lower loop extending thereunder. The upper loop, which is the free end of the needle thread loop from the needle eye detained above the throat plate, is caused to encounter edge 148 of finger 138, and is guided thereby into the bobbin thread accommodating passageway from which it moves between the downturned arm 88 of the bracket 84 and thread tensioning spring 90. As rotation of the looptaker beak continues, the needle thread loop is drawn off the looptaker beak 48. Rotation of the bobbin results in bobbin slot 94 being moved under the upper limb of the needle thread loop. Such upper limb enters the bobbin through slot 94 and the wrapping of thread onto the bobbin hub 154 is initiated. Slot 94 is skewed with respect to a radius of the bobbin to result in a tag end portion 156 of the thread extending over the bobbin and through needle hole 38 being moved across and between cam 120 and button 106 where the thread is quickly severed (see FIG. 3). Thereafter, continued rotation of the bobbin serves to wind thereon replenishment thread for later use as bobbin thread in the formation of lock stitches.

Figure 5:
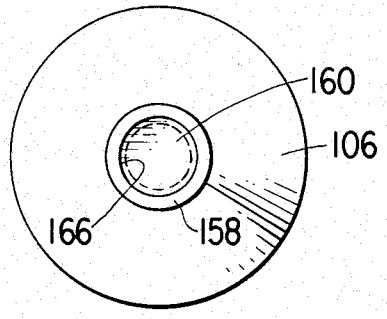
FIGS. 5, 6 and 7 are plan, elevational and sectional views respectively of a bobbin case plunger according to the invention.
Figure 8:
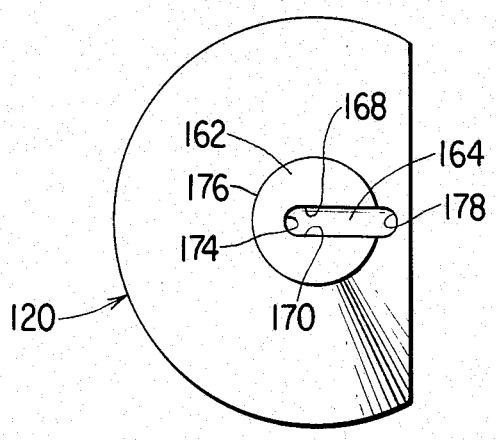
FIGS. 8, 9 and 10 are plan, elevational and side views respectively of a slide plate cam according to the invention.
Figure 6:
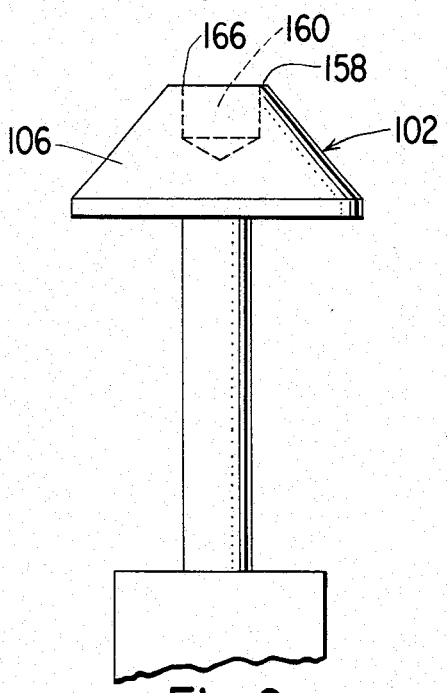
Figure 9:
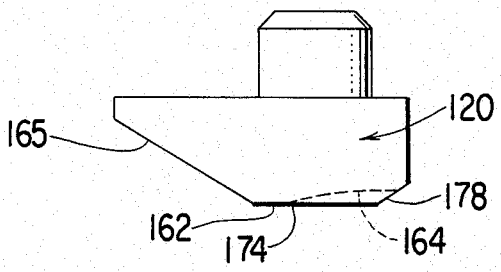
Figure 10:
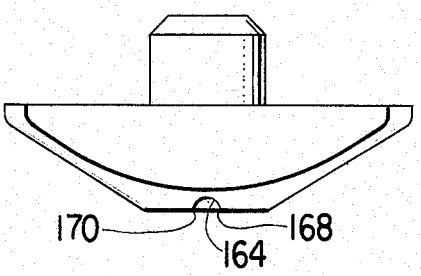
Figure 7:
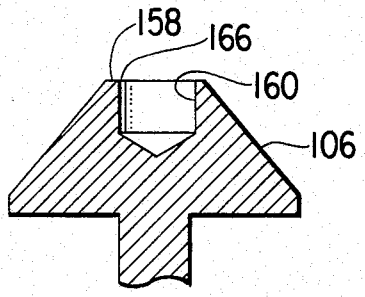

The tag end portion 156 of thread is severed without fail at the outset of the bobbin winding operation because of the particular manner in which plunger button 106 and slide plate cam 120 are constructed. As shown (see FIGS. 5, 6 and 7), the button is formed with a top planar surface 158 and a central blind hole 160 extending downwardly therefrom. The button flares outwardly and downwardly from the planar surface 158. Cam 120 (see FIGS. 8, 9 and 10), is formed with a bottom planar surface 162, an elongate slot 164 therein, and an inclined face 165 which extends upwardly from bottom planar surface 162. Hole 160 in button 106 defines a sharp edge 166 in planar surface 158, whereas elongate slot 164 in cam 120 defines sharp edges 168 and 170 on opposite sides of the slot in planar surface 162.

Figure 11:
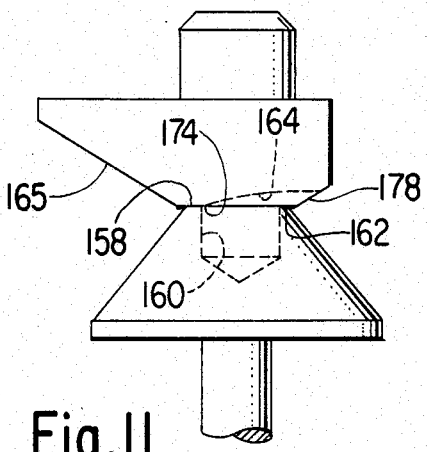
FIG. 11 is a side view showing the slide plate cam and plunger positions in bobbin winding positions.

In the bobbin winding position of slide plate 24 defined by the alignment of arrows A with arrows B, planar face 158 of the button is urged by the bias of spring 116 against planar face 162 of the cam and slides thereon. The sharp edges 168 and 170 of slot 164 then extend across the edge 166 of hole 160 (see FIG. 11), and as the tag end of thread is moved between the rotating button 106 and stationary cam 120, the thread is severed at the button by relatively moving sharp edges of hole 160 and slot 164.

After the bobbin has been replenished with thread, the slide plate 24 may be moved to the fully closed position (FIG. 2) and sewing operations resumed. The cam 120 is moved off button 106 by the slide plate, and plunger 116 is raised by spring 116 to disengage the plunger from chuck 124, and so discontinue rotation of the bobbin by the looptaker. Movement of the slide plate 24 into the fully closed position brings cam 152 into engagement with tang 150 and causes the finger to be moved away from the looptaker into a position permitting thread to pass over the thread accommodating passage in the bobbin case leading to the bobbin thread tensioning devices. During the sewing operation thread loops 172 cast by the needle are moved about the bobbin case 58 by looptaker 10 (see FIG. 4) and lockstitches are formed with the bobbin thread B in a manner well understood in the art.

One end 174 of cam slot 164 is located inwardly from the edge 176 of the bottom planar surface 162 of the cam 120 and the opposite end 178 is open at edge 176. The cam slot is oriented with respect to slide plate 24 so as to extend from end 174 to end 178 in a direction which is toward rather than away from needle 36. The open end 178 of the slot is therefor never exposed to a loop of thread 172 being moved about the bobbin case 58 by the looptaker during a sewing operation, and the upper portion of the loop can move across the bobbin without being caught on the edge of button 106 at the open end 178 of slot 164.

A particular embodiment of the invention has been shown and described by way of illustration. However, many modifications will occur to those skilled in the art, and it is intended to cover all changes and modifications falling within the true spirit and scope of the invention as set forth in the annexed claims.

I claim:

1. In the bed of a sewing machine; a rotatable looptaker; a bobbin case within the looptaker; a bobbin supported for rotation in the bobbin case; a bobbin driver; a plunger which is axially movable but rotationally confined in the bobbin, the plunger being spring biased upwardly and having an actuating button thereon which projects above the bobbin; a plate slidable in the bed; a cam on the plate movable by the plate between a position in which bobbin winding operations are performed on the machine and a position in which sewing operations are performed, the actuating button on the plunger including a top planar surface, and the cam including a bottom planar surface to engage said planar surface on the button in the bobbin winding position of the slide plate and thereby hold the plunger downwardly in the bobbin in a position wherein the plunger is connected to the driver and the bobbin is rotatable by the driver acting through the plunger, one of the said planar surfaces having a sharp edged hole therein and the other planar surface including a sharp edged elongate slot which is disposed to extend across the edge of said hole in the bobbin winding position of the slide plate.

2. The combination of claim 1 wherein the hole is in the top planar surface of the actuating button and the elongate slot is in the bottom planar surface of the cam.

3. The combination of claim 2 wherein the elongate slot extends toward the needle of the machine from an end located inwardly from the edge of the bottom planar surface of the cam.

4. The combination of claim 1 wherein the hole is centrally located in the actuating button.

5. The combination of claim 1 wherein the cam includes an inclined face which extends upwardly from the bottom planar face.

6. The combination of claim 5 wherein the button flares downwardly and outwardly from the top planar surface.

* * * * *